US006067922A

United States Patent [19]

Denison et al.

[11] Patent Number: 6,067,922

[45] Date of Patent: May 30, 2000

[54] COPPER PROTECTED FAIRINGS

[75] Inventors: Early Baggett Denison, New Orleans, La.; Richard Bruce McDaniel, Houston; David Wayne McMillan, Deer Park, both of Tex.

[73] Assignee: Shell Oil Company, Houston, Tex.

[21] Appl. No.: 09/067,366

[22] Filed: Apr. 27, 1998

Related U.S. Application Data

[60] Provisional application No. 60/045,518, May 8, 1997.

[51] Int. Cl.[7] ..... F15D 1/10; B63B 35/44

[52] U.S. Cl. ..... 114/243; 114/264

[58] Field of Search ..... 114/243, 264, 114/265, 258; 166/367

[56] References Cited

U.S. PATENT DOCUMENTS

| | | | |
|---|---|---|---|
| 4,078,605 | 3/1978 | Jones | 166/0.5 |
| 4,171,674 | 10/1979 | Hale | 114/243 |
| 4,389,487 | 6/1983 | Ries | 435/273 |
| 4,398,487 | 8/1983 | Ortloff et al. | 114/243 |
| 4,474,129 | 10/1984 | Watkins et al. | 114/243 |
| 5,410,979 | 5/1995 | Allen et al. | 114/243 |

*Primary Examiner*—S. Joseph Morano
*Assistant Examiner*—Patrick Craig Muldoon
*Attorney, Agent, or Firm*—Mark A. Smith

[57] ABSTRACT

A fairing system is disclosed for protecting a cylindrical marine element from drag and vortex induced vibration. A noncorrosive fairing shroud is rotatably mounted about the cylindrical marine element and defines an annular region between the exterior of the cylindrical marine element and the inside of the fairing shroud and at least one copper element is mounted at the annular region to discourage marine growth at the fairing shroud-cylindrical marine element interface. This enables the fairing to remain free to weathervane to orient most effectively with the current Another aspect of the present invention is a method for protecting a substantially cylindrical marine element from vortex-induced vibration in which a rotatable fairing is installed about the marine element and a marine growth inhibitor is mounted in active communication with the annular interface of the rotatable fairing and the cylindrical marine element.

15 Claims, 5 Drawing Sheets

COPPER PROTECTED FAIRINGS

This application claims benefit of provisional application Ser. No. 60/045,518 filed May 8, 1997.

BACKGROUND

The present invention relates to a method and apparatus for reducing vortex- induced-vibrations ("VIV") and, more particularly, reducing VIV in marine environments by the use of fairings.

Production of oil and gas from offshore fields has created many unique engineering challenges. One of these challenges is dealing with effects of currents on fixed cylindrical marine elements. Such marine elements are employed in a variety of applications, including, e.g., subsea pipelines; drilling, production, import and export risers; tendons for tension leg platforms; legs for traditional fixed and for compliant platforms; other mooring elements for deepwater platforms; and so forth. Ocean currents cause vortexes to shed from the sides of these marine elements, inducing vibrations that can lead to the failure of the marine elements or their supports.

Shrouds, strakes and fairings have been suggested for such applications to reduce vortex induced vibrations. Strakes and shrouds can be made to be effective regardless of the orientation of the current to the marine element. But shrouds and strakes are generally less effective than fairings and generally materially increase the drag acting on the marine element. By contrast, fairings are generally very effective in reducing vibrations due to vortex shedding, and also reduce drag forces on the marine element.

U.S. Pat. Nos. 4,389,487 and 4,474,129 disclose fairings for use with subsea pipes and risers which are provided with means to permit the fairing to rotate around the pipe or riser as would a weathervane in order to maintain an orientation presenting the fairing parallel to the current. However, the subsea environment in which the fairings must operate renders likely the rapid failure of the rotational elements. Further, traditional fairings present a very serious problem should corrosion or marine growth cause the rotational elements to seize up. Such a failure a traditional fairing to rotate would cause excessive drag forces on the marine element should the current shift and no longer align with the "frozen" fairing. As a result, rotatable fairings have, in actual practice, been limited to drilling riser applications in which the risers (together with fairing mounted thereon) are frequently and routinely retrieved and not left in service for extended periods.

An advantage of the present invention is to provide a fairing system that will remain free to weathervane to align with the most effective orientation to the current and which is resistant to fouling from marine growth that could inhibit the rotative freedom necessary to support this weathervaning.

SUMMARY OF THE INVENTION

The present invention is a fairing system for protecting a cylindrical marine element from drag and vortex induced vibration in which a non-corrosive fairing shroud is rotatably mounted about the cylindrical marine element and defines an annular region between the exterior of the cylindrical marine element and the inside of the fairing shroud. At least one copper element is mounted at the annular region to discourage marine growth at the fairing shroud-cylindrical marine element interface so that the fairing remains free to weathervane to orient most effectively with the current.

Another aspect of the present invention is a method for protecting a cylindrical marine element from vortex-induced vibration in which a rotatable fairing is installed about the marine element and a marine growth inhibitor is mounted in active communication with the annular interface of the rotatable fairing and the cylindrical marine element.

BRIEF DESCRIPTION OF THE DRAWINGS

The brief description above, as well as further objects and advantages of the present invention, will be more fully appreciated by reference to the following detailed description of the preferred embodiments which should be read in conjunction with the accompanying drawings in which.

DETAILED DESCRIPTION OF AN ILLUSTRATIVE EMBODIMENT

Figure 1:
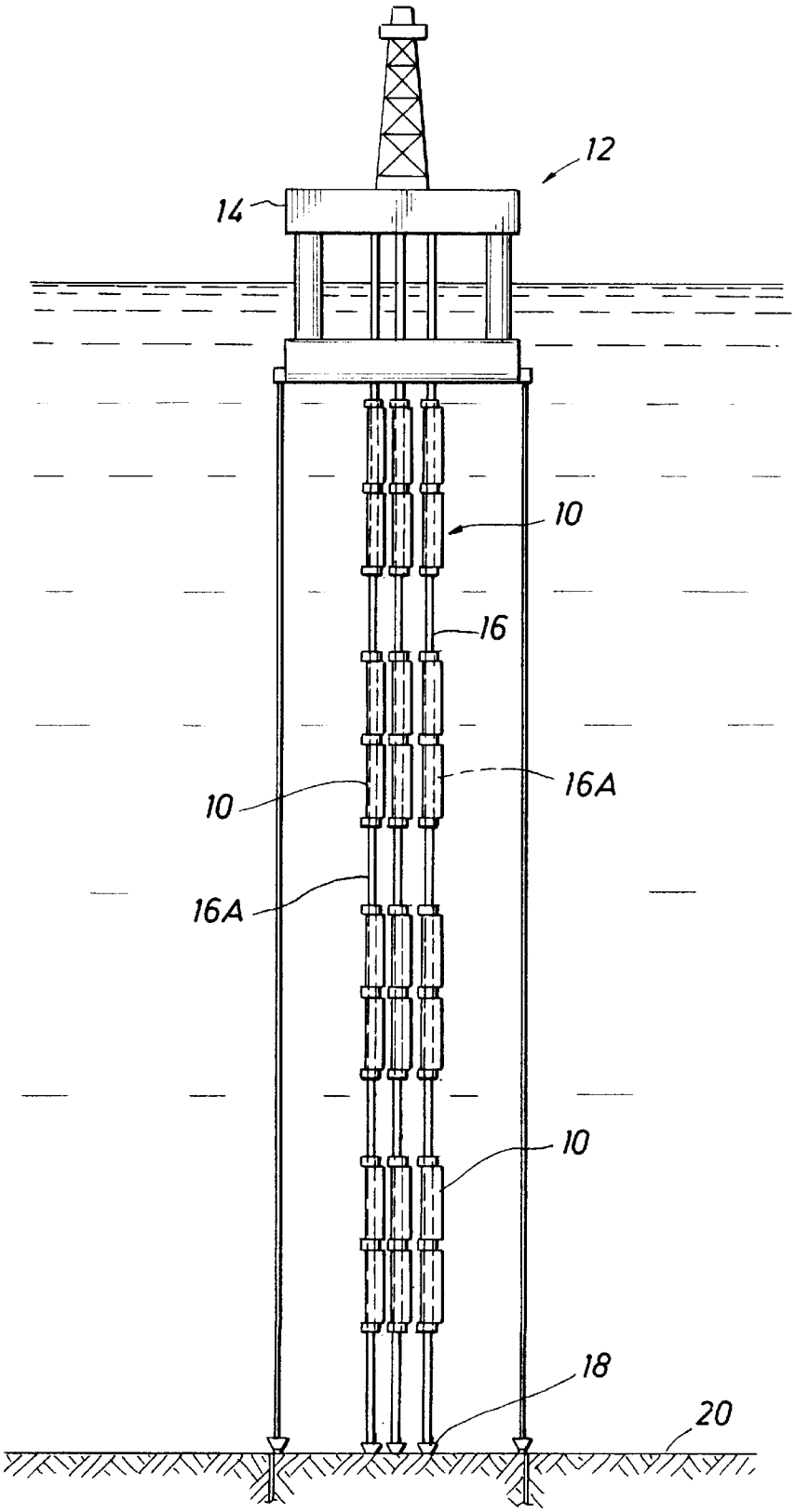
FIG. 1 is a side elevational view of an offshore platform deploying the present invention.

FIG. 1 illustrates an environment in which the present invention may be deployed. An offshore platform, here a tension leg platform ("TLP") 12, provides surface facilities 14. Production risers 16 descend from the beneath the deck of the surface facilities to wells 18 at ocean floor 20. This can be a half mile or more in deepwater developments and the production risers are not tied to supporting framework such as the conductor guides in traditional bottom-founded platforms. Buoyancy cans or floatation modules may be deployed along the length of the riser to render it neutrally buoyant, but horizontal or lateral loading from currents on this long, unsupported run is not alleviated by the addition of such buoyant support. Rather, the presence of buoyancy cans or floatation modules around the circumference of the risers materially increase the profile presented to the current and leads to greater drag and VIV effects. Unabated, the VIV can lead to premature failure of equipment in high current environments. However, fairing system 10 is installed along the production risers to manage VIV problems.

Figure 2A:
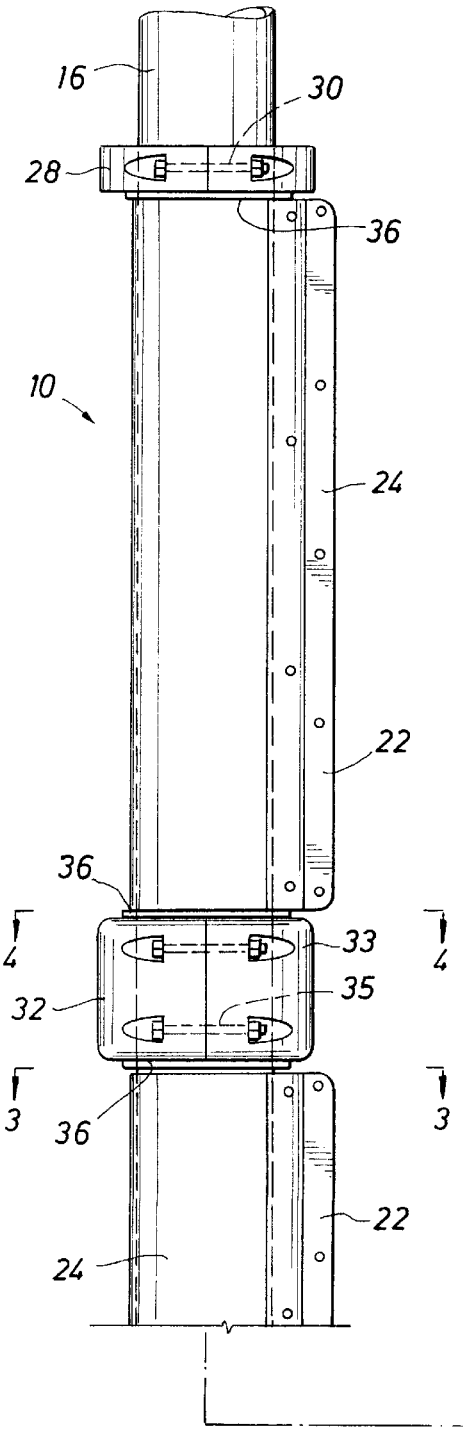
FIG. 2 is a side elevational view of a fairing system constructed in accordance with one embodiment of the present invention.
Figure 2B:
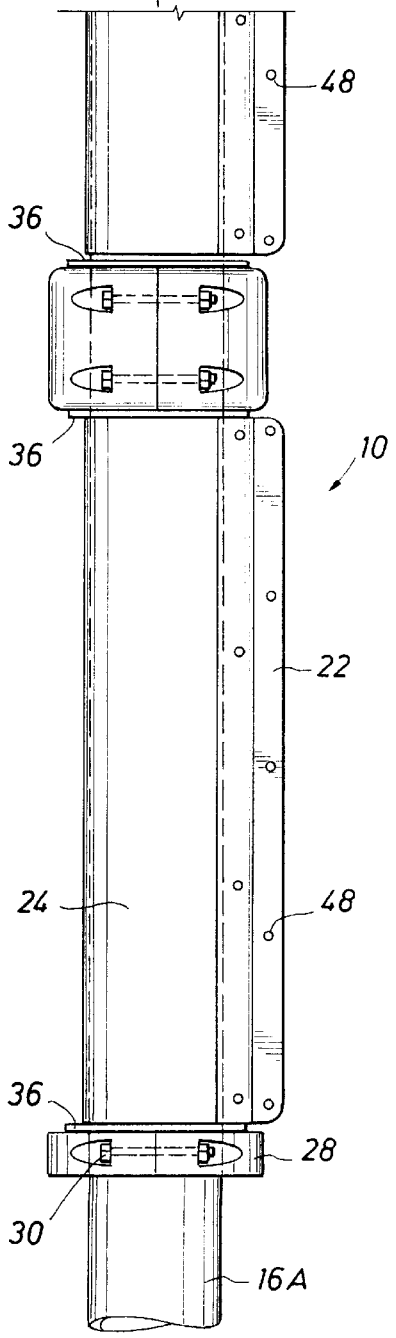

FIG. 2 illustrates one embodiment of a fairing system 10 installed about a cylindrical marine element 16, here illustrated by production riser 16A. Fairing shrouds 24 reduce drag and prevent VIV, freely rotating or weathervaning to the best orientation for optimum performance.

Fairing shrouds 24 of this fairing system 10 are arranged in an axially aligned series contained between upper and lower thrust collars 28. The thrust collars are fixedly connected to the riser 16A and can be conveniently fabricated from high density polyethelene and secured with fiberglass or nylon bolts 30 or the like and present load shoulders to the ends of the adjacent fairing shrouds.

Free floating buoyancy modules 32 separate the fairing shrouds 24 within the series bounded by thrust collars 28. The buoyancy modules present load shoulders to the ends of the adjacent fairing shrouds. Further, the axial load on the lower thrust collar 28 from the weight of the fairing shrouds 24 in the series can be offset with the buoyancy of modules 32. The modules may be conveniently formed in opposing halves using syntactic foam 33 with a wear resistant high density polyethelene ring 34 in the interior, next to the riser. The opposing halves are secured with bolts 35.

The fairing is most effective when the tail or flange 22 is aligned with the current. Further, a fairing that "freezes" and fails to rotate into optimal alignment increases the drag on the marine element. This limitation can be reduced through the use of short or ultrashort fairings, but remains a factor. Further, fairings having a traditional length which are very effective in proper orientation can produce serious drag problems if frozen in plce when the current shifts. Corrosion and marine growth are the principal causes for the fairings to become lodged in one orientation.

The dangers of corrosion and marine growth to the free rotation of fairing 10 about production riser are controlled in the present invention at the interface of the fairing shroud 24 and the cylindrical marine element 16. Corrosion is controlled by forming riser system with a fairing shroud 24 of a non-corrosive material such as heat-formed high density polyethelene.

Figure 3:
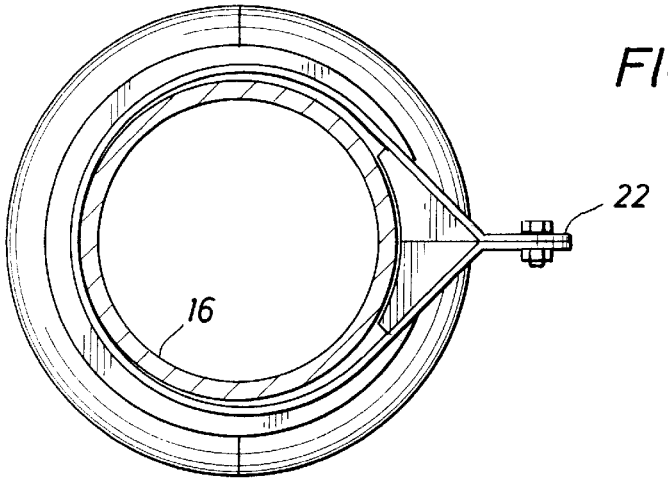
FIG. 3 is a cross sectional view of the fairing system of FIG. 2 taken at line 3—3 in FIG. 2.

Marine growth is discouraged at this interface by mounting a marine growth inhibitor, e.g., copper, immediately adjacent the interface between the fairing shroud and the cylindrical marine element. In this embodiment, copper rings 36 are presented on load shoulders of the thrust collars 28 and the buoyancy modules 32 on opposing ends of each of fairing shrouds 24. Further, a pair of copper bars 38 are mounted longitudinally along the inside of the fairing shrouds where the shrouds flare away from the riser toward tail flange 22 and are there secured, e.g., by nylon bolts 40. See also FIGS. 7 and 8. Barnacles, etc., will tend to avoid attaching on copper or immediately next to copper, especially in a partially enclosed area such an the annular space 26 between the fairing shroud and the cylindrical marine element. See FIG. 3.

Figure 4:
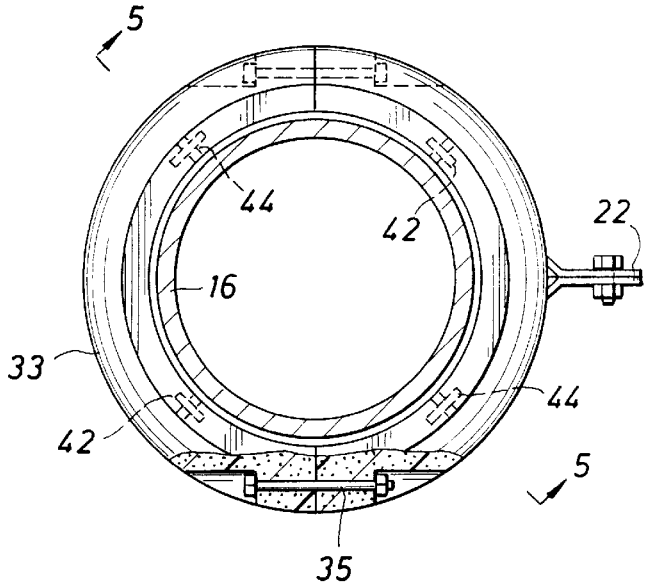
FIG. 4 is a cross sectional view of the fairing system of FIG. 2 taken at line 4—4 in FIG. 2.
Figure 5:
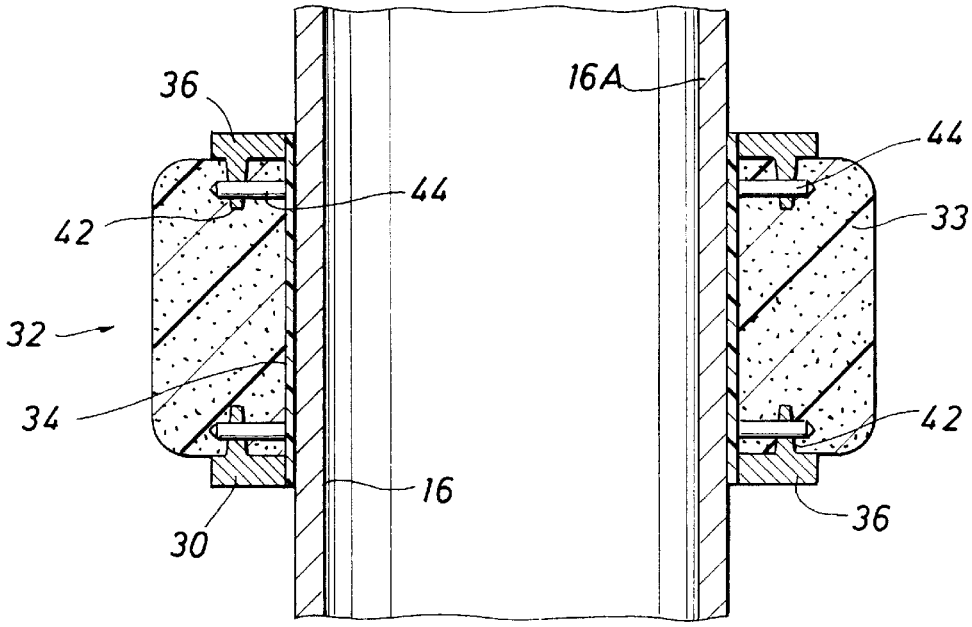
FIG. 5 is a cross sectional view of the fairing system of FIG. 2 taken at line 5—5 in FIG. 4.

FIGS. 4 and 5 illustrate one embodiment of buoyancy module 32 and one manner of mounting copper rings 36. In this embodiment the copper ring is provided with arms 42 projecting therefrom which are axially drilled to receive locking pins 44 conveniently made of fiberglass or Deldrin.

Figure 4A:
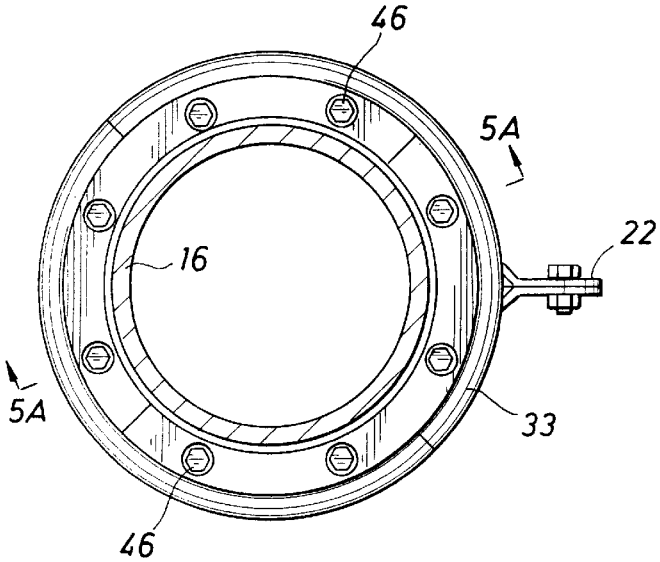
FIG. 4A is a cross sectional view of an alternate embodiment of the fairing system of FIG. 2 taken from the cut of line 4—4 in FIG. 2.
Figure 5A:
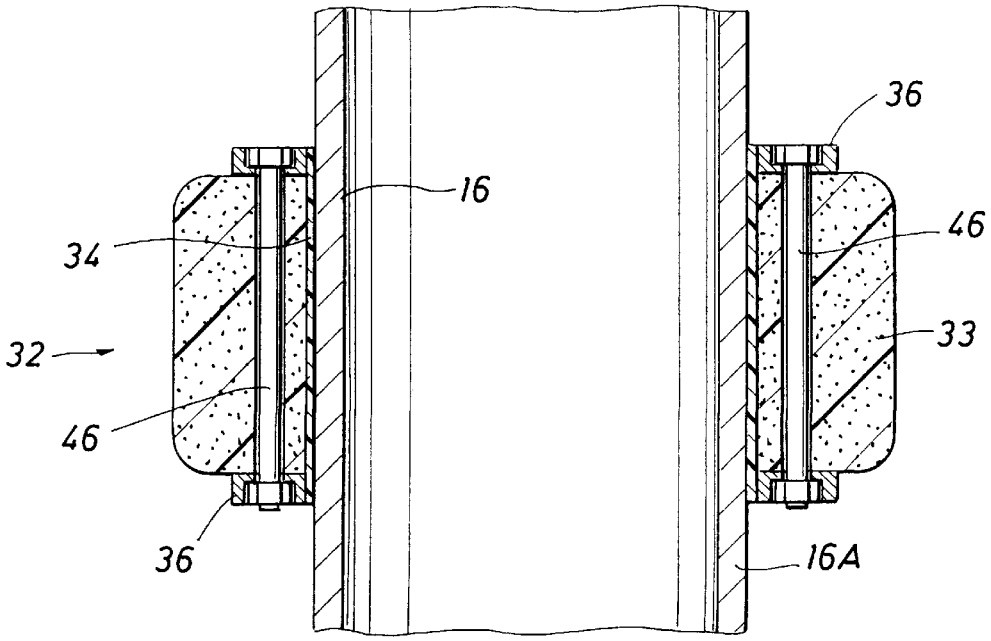
FIG. 5A is a cross sectional view of the fairing system of FIG. 4A taken at line 5A—5A in FIG. 4A.

FIGS. 4A and 5A illustrate another embodiment of the buoyancy modules 32 and manner of mounting copper rings 36. Here the rings are secured by bolts 46 connecting opposing copper rings through the buoyancy ring. The bolts are nonmetallic (e.g., nylon or fiberglass) and the heads and nuts of the bolts are recessed within the copper ring.

These same connection systems may be used to secure the copper rings on the thrust collars 28. However, in areas of greatest wear such as thrust collars 28, it may further be preferred to use a copper ring which is actually formed from a copper-nickel alloy (preferably retaining a high percentage of copper).

Figure 6:
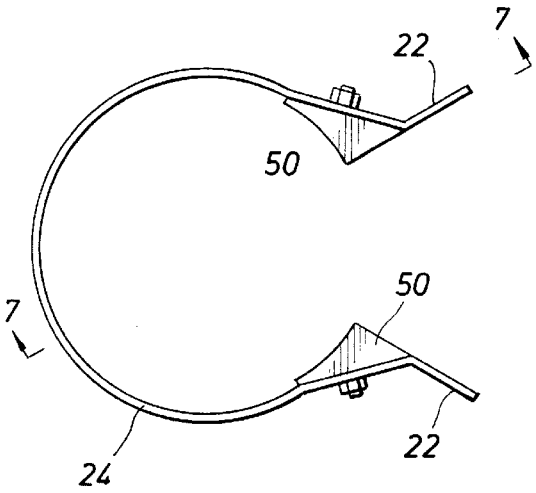
FIG. 6 is a top elevational view of a fairing shroud constructed in accordance with one embodiment of the present invention.
Figure 7:
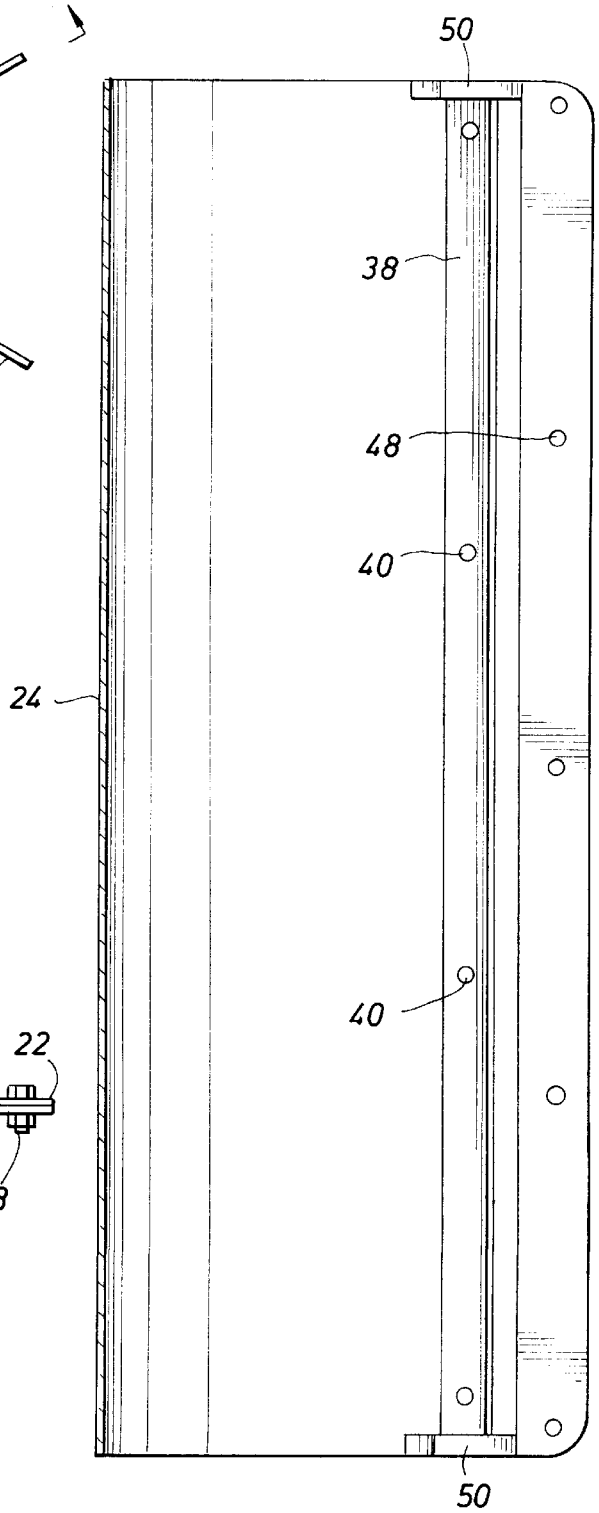
FIG. 7 is a side elevational view of a fairing shroud constructed in accordance with one embodiment of the present invention.
Figure 8:
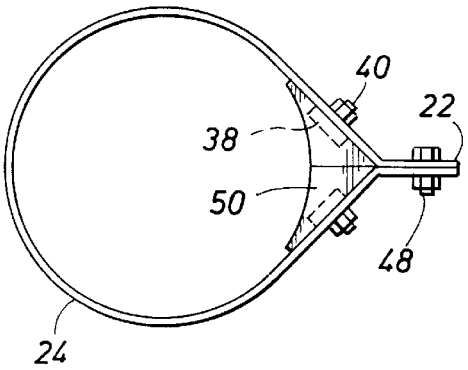
FIG. 8 is a top elevational view of a fairing shroud of a fairing system constructed in accordance with one embodiment of the present invention.

FIGS. 6–8 illustrate fairing shroud 24 in greater detail. FIG. 6 illustrates the fairing shroud sprung open for mounting on a riser section. FIG. 8 illustrates the fairing shroud closed and fastened at tail flange 22 with non-metallic bolts 48. In production riser applications, it may be convenient to fully assemble fairing system 10 about riser sections 16A onshore before deployment.

FIGS. 7 and 8 also best illustrates the copper bar mounted to the interior of the fairing shroud, beneath end plates 50 such that the copper does not directly contact riser 16A which are conventionally formed from steel tubulars. These end plates may be "welded" to the extruded fairing shroud elements.

The foregoing illustrative embodiments show the fairing system and method of the present invention applied to cylindrical marine elements in the form of production risers. However, cylindrical marine elements are employed in a variety of other applications, including, e.g., subsea pipelines; drilling, import and export risers; tendons for tension leg platforms; legs for traditional fixed and for compliant platforms; other mooring elements for deepwater platforms; and so forth. Those having ordinary skill in the art can readily apply these teachings to such other applications.

Further, other modifications, changes, and substitutions are also intended in the forgoing disclosure. And, in some instances, some features of the present invention will be employed without a corresponding use of other features described in these illustrative embodiments. Accordingly, it is appropriate that the appended claims be construed broadly and in a manner consistent with the spirit and scope of the invention herein.

What is claimed is:

1. A fairing system for protecting a cylindrical steel offshore marine element from drag and vortex induced vibration, said fairing system comprising:

a non-corrosive fairing shroud rotatably mounted about the cylindrical marine element and defining an annular region between the exterior of the cylindrical marine element and the inside of the fairing shroud; and at least one copper element mounted within in the fairing system in a manner that does not directly contact the steel offshore marine element, but that is active at the annular region to discourage marine growth at the fairing shroud-cylindrical steel offshore marine element interface.

2. A fairing system for protecting a cylindrical offshore marine element in accordance with claim 1 wherein the fairing system has a tail flange and the copper element is mounted longitudinally inside the fairing shroud at a flared region leading to the tail flange.

3. A fairing system for protecting a cylindrical offshore marine element in accordance with claim 1, further comprising:

a plurality of thrust collars fixedly connected to the cylindrical marine element such that the thrust collars axially contain one or more of the rotatable fairing shrouds between the thrust collars;

a load shoulder on each thrust collar facing one of the rotatable fairing shrouds; and a plurality of copper rings, each mounted one of the load shoulders adjacent one of the fairing shrouds.

4. A fairing system for protecting a cylindrical offshore marine element in accordance with claim 3, further comprising a plurality of the fairing shrouds rotatably mounted about the cylindrical marine element and grouped in a axially arranged series contained between pairs of the thrust collars;

a plurality of free floating buoyant collars, each disposed between adjacent fairing shrouds and comprising:

a buoyant element surrounding the cylindrical marine element;

axial facing load shoulders presented at the ends of the buoyant element; and a plurality of floating copper rings, each mounted on an axial facing load shoulder, immediately adjacent one of the fairing shrouds.

5. A fairing system for protecting a cylindrical offshore marine element in accordance with claim 4, further comprising a plurality of copper bars mounted longitudinally inside the fairing shrouds at a flared region leading to the tail flange of the fairing.

6. A fairing system for protecting a marine riser from drag and vortex induced vibration, said fairing system comprising:

a plurality of non-corrosive fairing shrouds rotatably mounted about the cylindrical marine element and defining an annular region between the exterior of the cylindrical marine element and the inside of the fairing shroud, said fairing shrouds further grouped into axially arranged series;

a plurality of thrust collars fixedly connected to the cylindrical marine element such that the thrust collars axially contain axially arranged series of fairing shrouds between load shoulders presented on the thrust collars; and a first plurality of copper rings mounted on the load shoulders adjacent the fairing shrouds but not in direct contact with the riser;

a plurality of free floating buoyant collars, each disposed between adjacent fairing shrouds within a series, the buoyant collars comprising:

a buoyant element surrounding the cylindrical marine element;

axial facing load shoulders presented at the ends of the buoyant element; and a second plurality of floating copper rings isolated from direct contact with the riser, each mounted on an axial facing load shoulder, immediately adjacent the fairing shroud; and a plurality of copper bars isolated from direct contact with the riser mounted longitudinally inside the fairing shrouds at a flared region leading to the tail flange of the fairing shrouds.

7. A fairing system for protecting a marine riser in accordance with claim 6 wherein the cylindrical marine element is a production riser.

8. A fairing system for protecting a marine riser in accordance with claim 7 wherein the fairing shrouds are formed of high density polyethelene.

9. A fairing system for protecting a marine riser in accordance with claim 7 wherein the thrust collars are formed of high density polyethelene.

10. A fairing system for protecting a marine riser in accordance with claim 9 wherein the free floating buoyant collar is formed of syntactic foam surrounding a high density polyethelene interface immediately adjacent the production riser.

11. A method for protecting a cylindrical steel offshore marine element from drag and vortex induced vibration, comprising:

installing a rotatable fairing about the marine element; and mounting a marine growth inhibitor in active communication with the annular interface of the rotatable fairing and the cylindrical marine element but isolated from direct contact with the steel riser.

12. A method for protecting a cylindrical steel marine element in accordance with claim 11 wherein mounting the marine growth inhibitor comprises placing copper rings on thrust collars mounted on the cylindrical marine element adjacent the axial ends of the rotatable fairing.

13. A method for protecting a cylindrical steel marine element in accordance with claim 11 wherein mounting the marine growth inhibitor comprises placing a copper bar within the annulus between the cylindrical marine element and the rotatable fairing.

14. A method for protecting a cylindrical steel marine element in accordance with claim 13 wherein mounting the marine growth inhibitor further comprises mounting the copper bar longitudinally along the inside of the tail flange of the rotatable fairing.

15. A method for protecting a cylindrical steel marine element in accordance with claim 14 wherein mounting the marine growth inhibitor further comprises placing copper rings on thrust collars mounted on the cylindrical marine element adjacent the axial ends of the rotatable fairing.

* * * * *